US009265290B2

(12) United States Patent
Cunliffe

(10) Patent No.: US 9,265,290 B2
(45) Date of Patent: Feb. 23, 2016

(54) SCOPE AND CAP FLAP FOR OUTDOOR WEAR

(76) Inventor: Stephen James Cunliffe, Marcola, OR (US)

( * ) Notice: Subject to any disclaimer, the term of this patent is extended or adjusted under 35 U.S.C. 154(b) by 163 days.

(21) Appl. No.: 13/507,194

(22) Filed: Jun. 11, 2012

(65) Prior Publication Data

US 2013/0326796 A1 Dec. 12, 2013

(51) Int. Cl.
*A41D 13/00* (2006.01)
*F41C 33/00* (2006.01)

(52) U.S. Cl.
CPC ..... *A41D 13/0012* (2013.01); *F41C 33/00* (2013.01)

(58) Field of Classification Search
CPC . A41D 31/00; A41D 27/20; A41D 2600/108; A41D 1/02; A41D 3/00; A41D 13/00; A41D 13/0012; A41D 27/08; A41D 27/12; A41D 2400/48; A41D 13/1209; A41D 15/04; A41D 27/205; A41D 13/0015; A41D 15/00
USPC ..... 2/247, 93–95, 108, 48, 51, 52; 42/96
See application file for complete search history.

(56) References Cited

U.S. PATENT DOCUMENTS

| | | | | | |
|---|---|---|---|---|---|
| 1,655,895 | A * | 1/1928 | Davis | 2/247 |
| 1,905,235 | A * | 4/1933 | Mandelert | 2/94 |
| 3,354,470 | A * | 11/1967 | Allen | 2/94 |
| 4,151,938 | A * | 5/1979 | Barker et al. | 224/183 |
| 4,667,347 | A * | 5/1987 | Greer | 2/247 |
| 5,063,614 | A * | 11/1991 | McSheffery | 2/94 |
| 5,195,187 | A * | 3/1993 | Yang | 2/102 |
| 5,465,425 | A * | 11/1995 | Crispin | 2/102 |
| 5,640,715 | A * | 6/1997 | Adams | 2/46 |
| 5,652,961 | A * | 8/1997 | Knight-Yurt | 2/114 |
| 6,820,281 | B2 * | 11/2004 | Mariland et al. | 2/115 |
| 2006/0253957 | A1 * | 11/2006 | Orozco | 2/171 |
| 2010/0115684 | A1 * | 5/2010 | Freedman et al. | 2/128 |

* cited by examiner

*Primary Examiner* — Andrew W Collins
(74) *Attorney, Agent, or Firm* — Teri G. Andrews

(57) ABSTRACT

A Scope and Cap Flap is attached to a piece of sporting outdoor wear. The Scope and Cap Flap has one flap attached to the left front chest portion and a second flap attached the right front chest portion. The two flaps are attached to one another to create the Scope and Cap Flap that drapes over a weapon held by a sportsman protecting the weapon from the elements while having the weapon readily accessible for a sporting activity such as hunting.

2 Claims, 6 Drawing Sheets

SCOPE AND CAP FLAP FOR OUTDOOR WEAR

FIELD OF THE INVENTION

The present invention relates generally to outdoor wear, and more specifically to outdoor wear used in hunting wherein the user's firearm needs to be protected from dirt and the weather.

BACKGROUND OF THE INVENTION

There are a multitude of sporting jackets and vests currently on the market that accommodate a sportsman for hunting, fishing, or other outdoor sports. Most of these jackets have the sportsman's comfort in mind, such as keeping them warm for cooler climates or keeping them cool in warmer climates. Many of these jackets have multiple pockets for accessories such as tackle or ammunition. The primary benefit of these pockets is to allow the sportsman to hunt or fish without having to carrying or strap on boxes or bags containing their accessories.

None of the above suggested jackets or vests have built-in protection for the sportsman's equipment. Many sportsmen hunt with very expensive firearms and prefer to avoid rain, hot sun, and dust from damaging their firearm and accessories. Some hunters use a rain poncho to shield their firearm from the elements. Unfortunately, ponchos can be noisy and difficult to retrieve or draw the firearm in a timely manner. Other hunters prefer to keep their firearm in a case or cover when not in use. Again, this protects the firearm, but adds time and potential noise to draw or ready the firearm to shoot.

Many hunters still prefer to hunt with a muzzleloader or 'cap and ball' type of firearm. With a muzzleloader, it is imperative that the cap stay dry to ensure cap ignition when the trigger is pulled. Typically, a muzzleloader hunter keeps his ammunition in a small, water resistant cross-body or shoulder bag. This bag keeps the contents dry, but not the muzzleloader itself. Accumulated water on or around the action can easily cause a cap to misfire due to moisture thereby missing the opportunity to shoot the often long-hunted game. Additionally, retrieving ammunition components quickly from the bag can be both cumbersome and noisy. Quick and quiet loading is critical to successful muzzleloader hunting.

For the scope and rifle hunter, moisture and dirt can also be an issue. Typically, when a scope is used the hunter leaves the scope caps on when not in use keeping the scope lenses clean and water free. Removing scope caps quickly can be awkward and slow the response time of the hunter. Although some hunters carry a cover of some type to drape over their rifle and scope as element protection, removal of the cover is still time consuming and requires stowing the cover or letting it fall to the ground leaving it wet, dirty, and often useless for a second use.

Sportsmen tend to carry a variety of supplies and accessories such as ammunition, cell phones, hand warmers, maps, wildlife calls, time pieces, snacks, a dry towel and the like. Often this requires an additional bag or loading pant and jacket pockets to accommodate essential needs during a chosen activity. Bags can be cumbersome and make it difficult to retrieve supplies and accessories quietly and efficiently.

There is a need for improved sporting outdoor wear that protects both the sportsman and his gear from the elements while maintaining the ability of the sportsman to draw his weapon quickly and quietly.

SUMMARY OF THE INVENTION

The present invention is a Scope and Cap Flap for outdoor wear providing protection for a sportsman's firearm, accessories and the like from the elements while engaging in outdoor sports. The Scope and Cap Flap is either a single flap or comprises a left flap and a right flap attached to the chest portion of a sporting or hunting jacket such that with the flaps connected to one another they make a weather resistant cover which drapes over a sportsman's Firearm.

It is an object of the present invention to make the Scope and Cap Flap functional for protecting or sheltering the cap of a muzzleloader style firearm, a rifle with a scope, or any other piece of sporting equipment a sportsman may care to protect from dirt or the elements.

It is another object of the present invention to provide handy pockets and pouches within the Scope and Cap Flap for miscellaneous sporting and personal accessories.

BRIEF DESCRIPTION OF THE DRAWINGS

The above description and other objects, advantages, and features of the present invention will be more fully understood and appreciated by reference to the specification and accompanying drawings, wherein.

| DRAWING ELEMENT NUMBERS: | |
|---|---|
| 100 | Jacket |
| 101 | Scope and Cap Flap |
| 102 | 1st Flap |
| 104 | 2nd Flap |
| 106 | 1st Attach Tab |
| 108 | 2nd Attach Tab |
| 110 | Firearm |
| 112 | Zipper Cover |
| 114 | Arms |
| 116 | Flap Secure |
| 200 | Vest |
| 201 | Single Scope and Cap Flap |
| 206 | Zipper |
| 212 | Cap/Action |
| 301 | Tab Attachment |
| 302 | Flap Attachment |
| 304 | Flap Closure |
| 306 | Casing |
| 308 | 2nd Flap Back |
| 400 | 2nd Alternate Jacket |
| 401 | Snap Scope and Cap Flap |
| 402 | Snap 1st Flap |
| 404 | Snap 2nd Flap |
| 406 | Rifle |
| 408 | Scope |
| 410 | Jacket Snap Placket |

-continued

| DRAWING ELEMENT NUMBERS: | |
|---|---|
| 412 | Flap Snap Placket |
| 502 | Flap Stabilizer |
| 504 | Simple Pouch |
| 505 | Alternate Tab Attachment |
| 506 | Alternate Flap Attachment |
| 602 | 1st Pocket Flap Back |
| 604 | 2nd Pocket Flap Back |
| 606 | 1st Pocket Zipper |
| 608 | 2nd Pocket Zipper |
| 612 | 1st Pouch |
| 614 | 2nd Pouch |
| 616 | 1st Pocket Upper Edge |
| 618 | 1st Pocket Lower Edge |
| 620 | 1st Pocket Interior |
| 622 | 1st Pocket |
| 624 | 2nd Pocket |
| 626 | 2nd Pocket Upper Edge |
| 628 | 2nd Pocket Lower Edge |

DETAILED DISCUSSION OF THE PREFERRED EMBODIMENTS

Referring to the figures, like elements retain their indicators throughout the several views.

Figure 1:
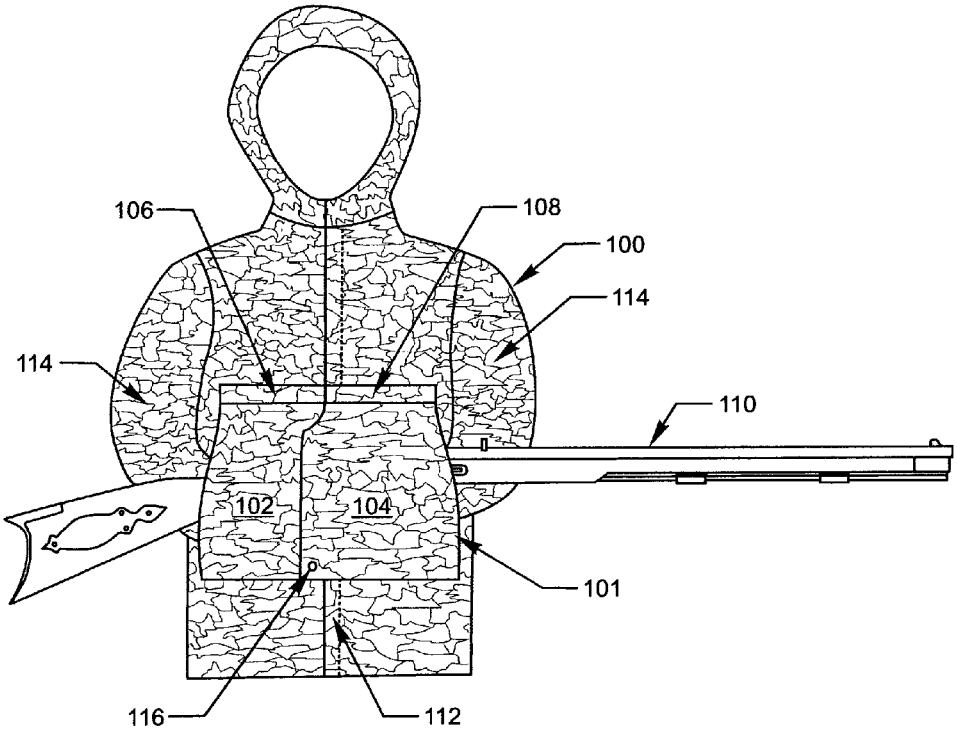
FIG. 1 is a front, plan view of a sporting jacket having the scope and cap flap of the present invention.

FIG. 1 is a front, plan view of Jacket 100 depicting Scope and Cap Flap 101 of the present invention. Jacket 100 is a typical outdoor sporting jacket constructed from water-resistant or waterproof material. First Jacket Tab 106 and 2nd Jacket Tab 108 are attached to the chest front of Jacket 100 as shown. Scope and Cap Flap 101 has a 1st Flap 102 attached to 1st Jacket Tab 106 and a 2nd Flap 104 attached to 2nd Jacket Tab 108 where 1st Jacket Tab 106 and 2nd Jack Tab 108 function as both connection means for Scope and Cap Flap 101 as well as protection from rain and the elements.

In the preferred embodiment, Scope and Cap Flap 101 is easily detached from Jacket 100. Although Scope and Cap Flap 101 adds minimal weight to Jacket 100, the user may choose to detach Scope and Cap Flap 101 from Jacket 100 adding versatility to Jacket 100.

With Scope and Cap Flap 101 attached to Jacket 100 only on the upper edge, the user can hold Firearm 110 comfortably under Scope and Cap Flap 101 such that Firearm 110 is protected from the weather yet readily available for raising, aiming and firing of Firearm 110. In addition to keeping Firearm 110 dry, Scope and Cap Flap 101 also protects the user's hands from the elements.

Flap Secure 116 is an optional snap securing the closure of the lower edge of Scope and Cap Flap 101. Construction and details of Scope and Cap Flap 101 will be described in the discussion of figures to follow.

Figure 2:
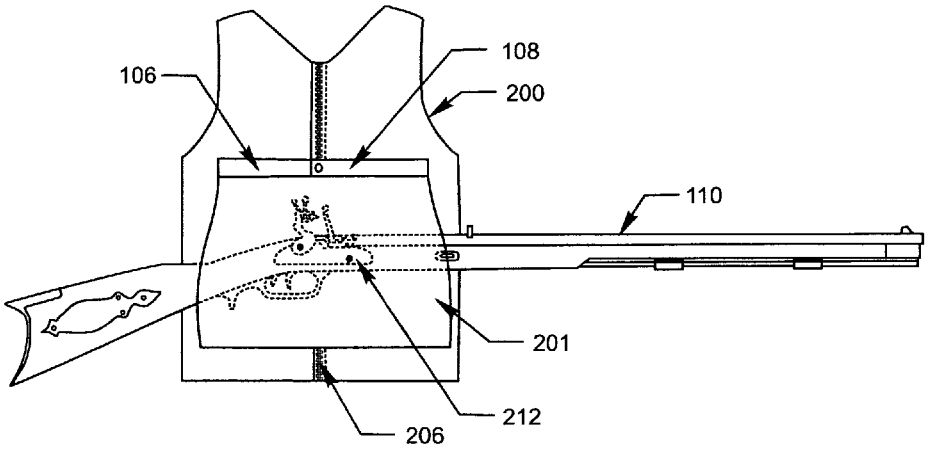
FIG. 2 is a front, plan view of a sporting vest illustrating an alternate apparel closure and an alternate single piece scope and cap flap.

FIG. 2 is a front, plan view of sporting Vest 200 illustrating an alternate use and alternate closure means for the present invention. As shown, Vest 200 closes with Zipper 206. In this alternate embodiment, Single Scope and Cap Flap 201 is a continuous piece which is attached on an upper edge by 1st Attach Tab 106 and 2nd Attach Tab 108. With Zipper 206 zipped closed, Single Scope and Cap Flap 201 is a solid weather resistant piece draping over Firearm 110 protecting it from the elements.

Cap/Action 212 of Firearm 110 is shown in phantom in FIG. 2 further illustrating the protection provided by Single Scope and Cap Flap 201. In this embodiment, Firearm 110 is a muzzleloader style rifle. As any muzzleloader sportsman can appreciate, it is critical to have a dry cap to shoot. With Single Scope and Cap Flap 201 draped over Cap/Action 212, Cap/Action 212 is kept clean and dry in preparation for use.

While FIG. 1 shows Scope and Cap Flap 101 attached to a jacket and FIG. 2 shows Single Scope and Cap Flap 201 attached to a vest, it has been contemplated to add a Scope and Cap Flap to a variety of outdoor garments. Additionally, it has been contemplated for the Scope and Cap Flap to be manufactured as a kit that can be an add-on to a sportsman's existing jacket or outdoor garment.

Figure 3:
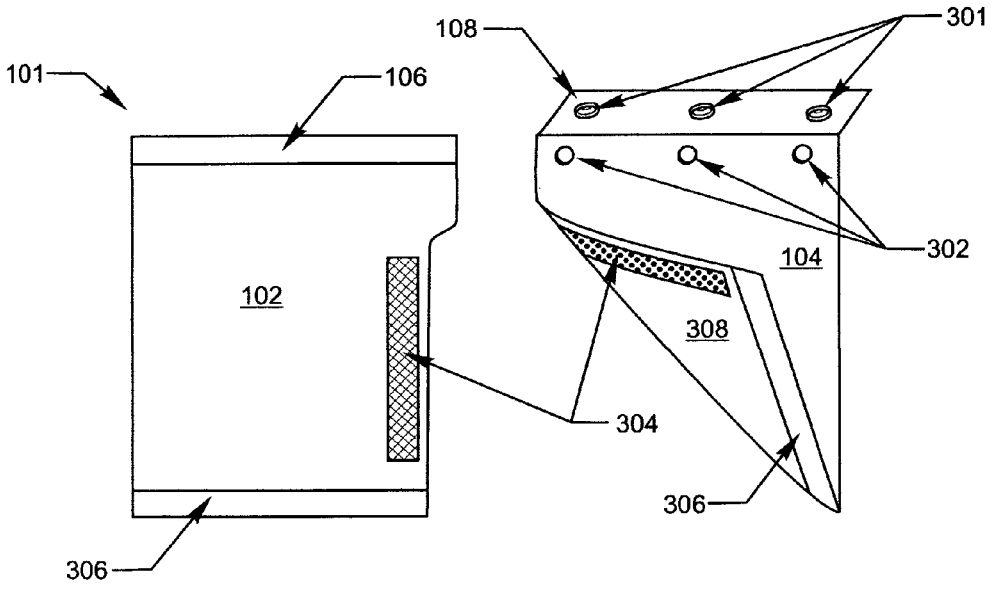
FIG. 3 is a front view of the scope and cap flap of the present invention detailing elements of the scope and cap flap.

FIG. 3 is a front view of Scope and Cap Flap 101 of the present invention detailing elements of Scope and Cap Flap 101. First Flap 102 is shown secured to 1st Attach Tab 106. Second Flap 104 is shown with 2nd Attach Tab 108 raised and showing Tab Attachment 301 which are shown as snaps. Flap Attachment 302 on 2nd Flap 104 are also snaps and spaced similarly to Tab Attachment 301 for mating and attachment of 2nd Flap 104. In the preferred embodiment, Scope and Cap Flap 101 is made of a similar fabric as Jacket 100 or Vest 200 and can be easily rolled or folded to fit in a pocket of Jacket 100 or Vest 200.

With both 1st Flap 102 and 2nd Flap 104 securely fastened to 1st Attach Tab 106 and 2nd Attach Tab 108 respectively, Flap Closure 304 is mated and secured creating a one piece Scope and Cap Flap 101. As shown, one side of Flap Closure 304 is affixed to 2" Flap Back 308 and the other side to the front of 1st Flap 102 creating an overlap of material when closed. In the preferred embodiment, Flap Closure 304 is a hook and loop fastener such as a Velcro® brand fastener. It has also been contemplated that Flap Closure 308 be snaps or other closure means.

Casing 306 on the lower edge of both 1st Flap 102 and 2nd Flap 104 are folded and sewn portions of Scope and Cap Flap 101 that contain a flap stabilizer (not shown) to both maintain flatness and add a small amount of weight keeping Scope and Cap Flap 101 draped over the user's firearm during movement and in windy conditions.

Figure 4:
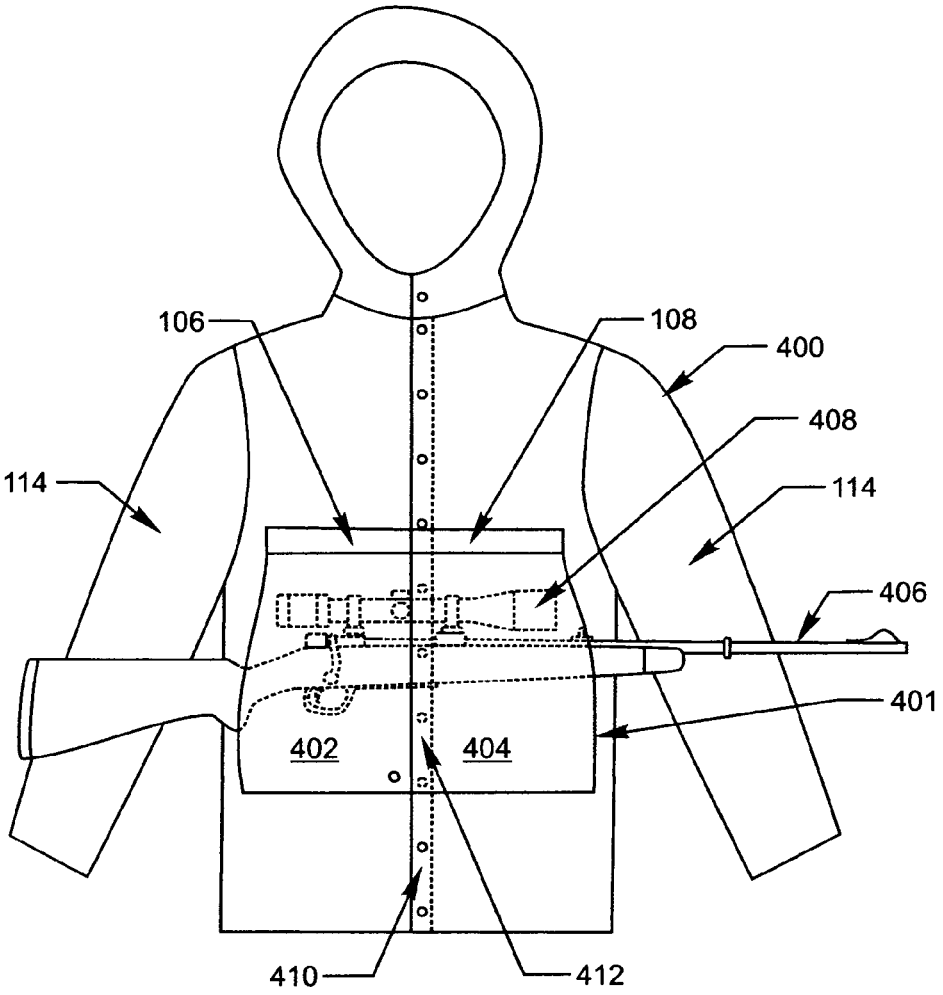
FIG. 4 is a front, plan view of an alternate sporting jacket illustrating a second alternate jacket closure along with an alternate scope and cap flap.

FIG. 4 is a front, plan view of Alternate Jacket 400 illustrating a second alternate jacket closure along with alternate Snap Scope and Cap Flap 401. Alternate Jacket 400 closes with a commonly known Jacket Snap Placket 410. Snap Scope and Cap Flap 401 also closes with Flap Snap Placket 412. Similar to previous discussions, 1st Snap Flap 402 and 2nd Snap Flap 404 attach to Alternate Jacket 400 by fastening means (not shown) on 1st Attach Tab 106 and 2nd Attach Tab 108 respectively.

As shown in FIG. 4, the illustrated firearm, Rifle 406, has an attached Scope 408 (shown in phantom). The combination of Rifle 406 and Scope 408 is larger in size than Firearm 110 shown and discussed in FIG. 2 requiring Snap Scope and Cap Flap 401 to be slightly longer that Scope and Cap Flap 101 ensuring coverage or shelter for both Rifle 406 and Scope 408.

As previously discussed, a hunter typically keeps the caps on the lenses of his rifle scope to avoid water, dust, and the like from the scope lenses that will potentially impair the accuracy of the user's view through the scope. As most hunters can appreciate, time is of the essence when hunting most game and removal of scope caps in haste can be noisy and time consuming. The Scope and Cap Flap of the present invention eliminates the need to leave lens caps on while traveling through the woods hunting as the entire scope is sheltered from the elements and makes the hunter's firearm ready to use valuable seconds quicker.

It has been contemplated to make the Scope and Cap Flap of the present invention a size that will accommodate both a muzzleloader and a rifle/scope combination. It has also been contemplated to have the user select an optional Scope and Cap Flap when purchasing a jacket according to sport preference. Additionally, it has been contemplated to supply the jacket with multiple sizes of Scope and Cap Flaps.

Figure 5:
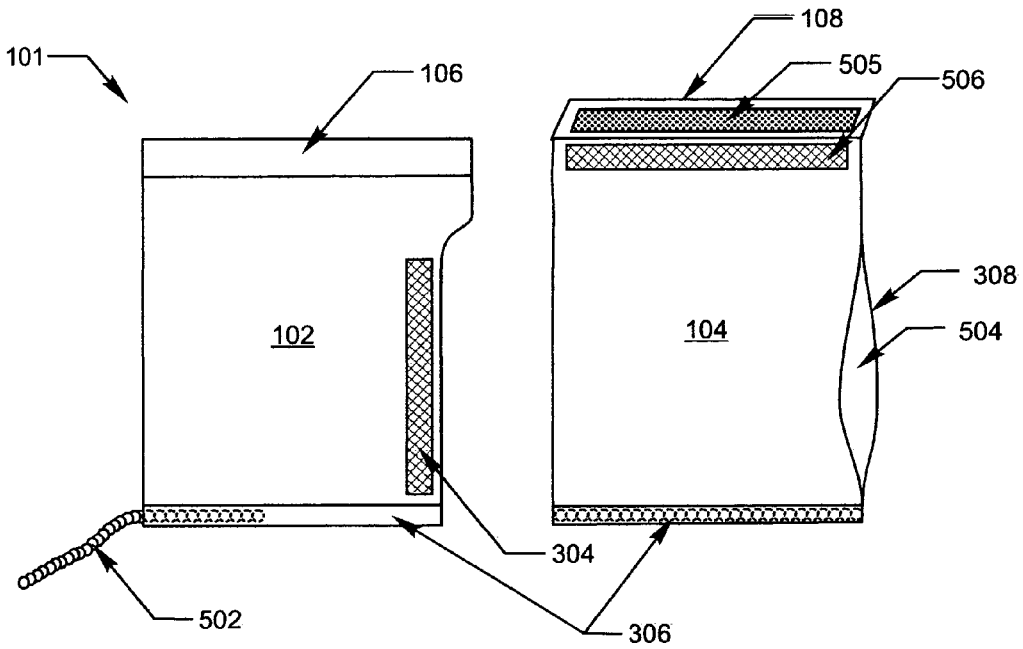
FIG. 5 is a front view of the scope and cap flap of the present invention depicting alternate flap attachment and an optional pouch within a flap.

FIG. 5 is a front view of Scope and Cap Flap 101 of the present invention depicting hook and loop fastener Alternate Flap Attachment 506, and Alternate Tab Attachment 505. Simple Pouch 504 is shown disposed within $2^{nd}$ Flap 104. With $2^{nd}$ Flap Back and $2^{nd}$ Flap constructed of separated pieces of fabric and attached along their upper and lower edges, Simple Pouch 504 is created between the two fabrics creating a dry pouch for accessories such as a map, hand warmer, or peripheral sporting gear the user may want to keep dry and readily accessible. Although not shown, a pouch similar to Simple Pouch 504 is disposed within $1^{st}$ Flap 102.

Alternate Attachment 506 is a hook and loop fastener such as a Velcro® brand fastener and is disposed on the inside surface of $2^{nd}$ Attach Tab 108 and the upper edge of $2^{nd}$ Flap 104. First Attach Tab 104 is attached to $1^{st}$ Flap 102 in a similar manner (not shown). As previously discussed, Flap Closure 304 is also a hook and loop fastener and joins $1^{st}$ Flap 102 and $2^{nd}$ Flap 104 to create Scope and Cap Flap 101.

FIG. 5 further details the placement of Flap Stabilizer 502 in Casing 306 disposed along the lower edges of $1^{st}$ Flap 102 and $2^{nd}$ Flap 104. As shown, Flap Stabilizer 502 is a flexible device which slides into Casing 306 and in the preferred embodiment is secured by stitching, rivets, or the like on either end such that when installed Flap Stabilizer 502 is not visible and will not slide out. In the preferred embodiment, Flap Stabilizer 502 is a well-known fishing item commonly called a "slinky weight" that is made by fishing tackle suppliers such as Eagle Claw and Daniels. The slinky weight is constructed from a length of weighted beads, such as lead, enclosed in a sleeve of pliable fabric or plastic. Flap Stabilizer 502 adds weight to the lower edge of Scope and Cap Flap 101 such that Scope and Cap Flap 101 drapes over the user's firearm protecting it from sun, rain, dirt and the like while not in use. It has also been contemplated that Flap Stabilizer 502 be a length of plastic or other firm material.

Figure 6:
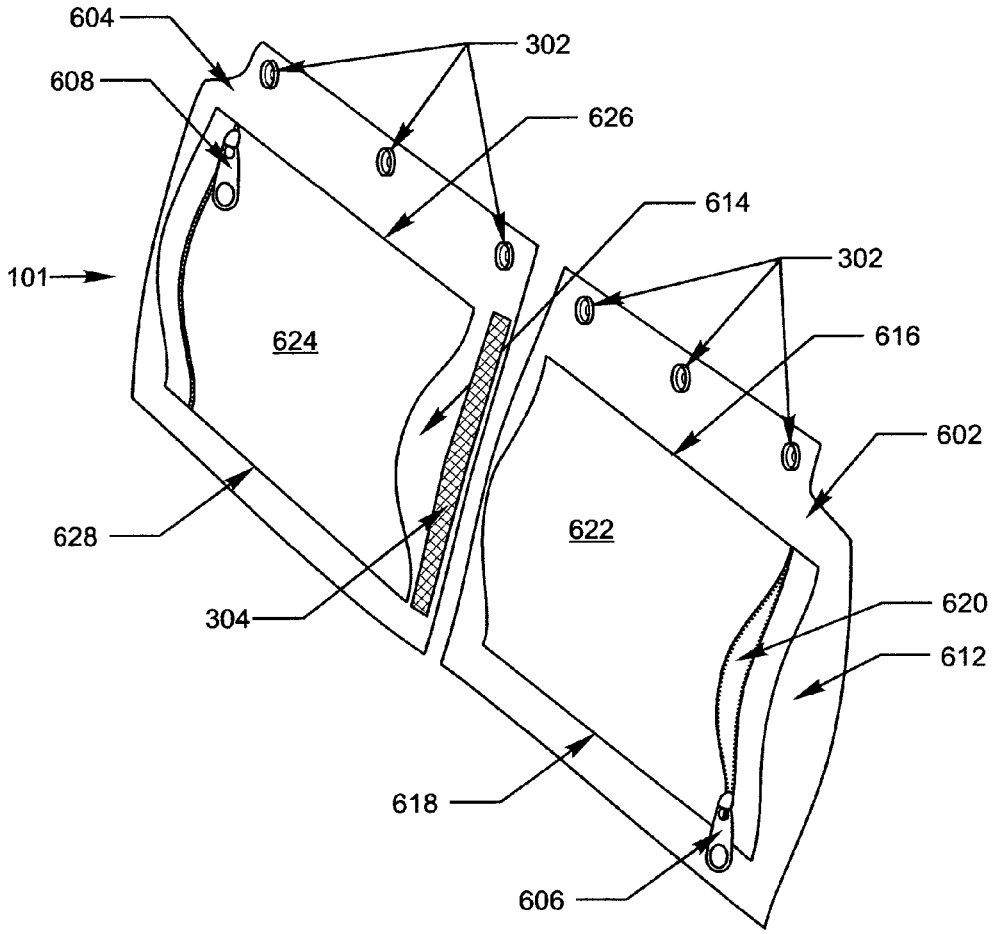
FIG. 6 is a perspective view of an alternate scope and cap flap of the present invention depicting zippered pockets and pouches disposed on the backs of the flaps.

FIG. 6 is a perspective view of Scope and Cap Flap 101 of the present invention depicting optional functional additions disposed on the back of Scope and Cap Flap 101. In addition to covering and protecting a user's weapon, Scope and Cap Flap 101 functions as a useful holder for supplies and accessories that may be needed or wanted during sport activities.

As shown in FIG. 6, $1^{st}$ Pocket 622 is attached to $1^{st}$ Pocket Flap Back 602 along $1^{st}$ Pocket Upper Edge 616 and along $1^{st}$ Pocket Lower Edge 618 such that $1^{st}$ Pouch 612 is created as shown, and accessible from either side of $1^{st}$ Pocket 622.

In this alternate embodiment, First Pocket 622 is constructed of two thicknesses of fabric such that $1^{st}$ Pocket Zipper 606 opens to $1^{st}$ Pocket Interior 620. Similarly, $2^{nd}$ Pocket 624 is attached to $2^{nd}$ Pocket Flap Back 604 along $2^{nd}$ Pocket Upper Edge 626 and along $2^{nd}$ Pocket Lower Edge 628 such that $2^{nd}$ Pouch 614 is created. Second Pocket 624 is also constructed of a double thickness of material with $2^{nd}$ Pocket Zipper 608 opening to the interior (not shown) of $2^{nd}$ Pocket 624.

It has also been contemplated to sew the outer edges of $1^{st}$ Pocket 622 and 2nd Pocket 624 closed such that $1^{st}$ Pouch 612 and $2^{nd}$ Pouch 614 are enclosed on three sides adding additional weather protection for the contents.

The many features and embodiments of the Scope and Cap Flap of the present invention shown and discussed above make the Scope and Cap Flap a solution to sporting activities where the sportsman's equipment is kept clean, dry, and immediately ready to use while accommodating the sportsman with needed accessories and supplies within easy reach.

Wherein the terms and expressions which have been employed in the foregoing specification are used therein as terms of description and not of limitation, there is no intention, in the use of such terms and expressions, of excluding equivalents of the features shown and described or portions thereof, it being recognized that the scope of the invention is defined and limited only by the claims which follow.

I claim:

1. A Scope and Cap Flap for an article of outdoor wear, the outdoor wear having a left front portion, a right front portion, a vertical closure disposed between the left front portion and the right front portion and extending a length of the outdoor wear, consisting of:

a first attach tab having a first width and fixedly attached horizontally across the right front portion at a chest height of a wearer, having a tab attachment fixedly attached along said first width;

a second attach tab having a second width and fixedly attached horizontally across the left front portion at said chest height, having a second tab attachment fixedly attached along said second width;

a rectangular first flap having a top edge approximate said first width, a bottom edge opposite said top edge, an inside edge, and outside edge opposite said inside edge, and a flap attachment fixedly attached along said top edge;

a rectangular second flap having a second top edge approximate said second width, a second bottom edge opposite said second top edge, a second inside edge, a second outside edge opposite said second inside edge, and a second flap attachment fixedly attached along said second top edge;

a first casing formed by folding and securing said bottom edge of said first flap and a first flap stabilizer is disposed in said first casing;

a second casing formed by folding and securing said second bottom edge of said second flap and a second flap stabilizer is disposed in said second casing; and a flap closure having a first closure and a second closure, said first closure fixedly attached along said inside edge of said first flap and said second closure fixedly attached along said second inside edge of said second flap;

wherein, said first flap is removeably attached at said top edge at said flap attachment to said first attach tab with said tab attachment, said second flap is removeably attached at said second flap attachment to said second top edge to said second attach tab with said second tab attachment, said first flap and said second flap are removeably attached with said first closure and said second closure mating approximate and parallel to the closure of the outdoor wear such that the assembled Scope and Cap Flap is easily draped over a sportsman's sporting equipment providing protection from the elements.

2. A Scope and Cap Flap for an article of outdoor wear, the outdoor wear having a left front portion, a right front portion, a vertical closure disposed between the left front portion and the right front portion and extending a length of the outdoor wear, consisting of:

a first attach tab having a first width and fixedly attached horizontally across the right front portion at a chest height of a wearer, having a tab attachment fixedly attached along said first width;

a second attach tab having a second width and fixedly attached horizontally across the left front portion at said chest height, having a second tab attachment fixedly attached along said second width;

a rectangular first flap having a top edge approximate said first width, a bottom edge opposite said top edge, an inside edge, an outside edge opposite said inside edge, and a flap attachment fixedly attached along said top edge;

a rectangular second flap having a second top edge approximate said second width, a second bottom edge opposite said second top edge, a second inside edge, a second outside edge opposite said second inside edge, and a second flap attachment fixedly attached along said second top edge;

a first casing formed by folding and securing said bottom edge of said first flap and a first flap stabilizer is disposed in said first casing;

a second casing formed by folding and securing said second bottom edge of said second flap and a second flap stabilizer is disposed in said second casing;

a flap closure having a first closure and a second closure, said first closure fixedly attached along said inside edge of said first flap and said second closure fixedly attached along said second inside edge of said second flap;

at least one pocket disposed on a back side of said first flap; and at least one pocket disposed on a second back side of said second flap;

wherein, said first flap is removeably attached at said top edge at said flap attachment to said first attach tab with said tab attachment, said second flap is removeably attached at said second flap attachment to said second top edge of said second attach tab with said second tab attachment, said first flap and said second flap are removeably attached with said first closure and said second closure mating approximate and parallel to the closure of the outdoor wear such that the assembled Scope and Cap Flap is easily draped over a sportsman's sporting equipment providing protection from the elements.

* * * * *